US009713762B2

(12) United States Patent
MacDonald et al.

(10) Patent No.: US 9,713,762 B2
(45) Date of Patent: Jul. 25, 2017

(54) TWO-WHEEL ROULETTE GAME

(71) Applicant: Las Vegas Sands Corp., Las Vegas, NV (US)

(72) Inventors: Andrew MacDonald, Singapore (SG); Baybars Bora Oral, Singapore (SG); Cetin Tanisman, Macau (CN)

(73) Assignees: Las Vegas Sands Corp., Las Vegas, NV (US); Venetian Macau Limited, Macau (CN)

( * ) Notice: Subject to any disclaimer, the term of this patent is extended or adjusted under 35 U.S.C. 154(b) by 0 days.

(21) Appl. No.: 14/099,875

(22) Filed: Dec. 6, 2013

(65) Prior Publication Data

US 2014/0210164 A1 Jul. 31, 2014

Related U.S. Application Data

(60) Provisional application No. 61/758,736, filed on Jan. 30, 2013.

(51) Int. Cl.

| | |
|---|---|
| ***A63F 1/18*** | (2006.01) |
| ***A63F 5/00*** | (2006.01) |
| ***A63F 1/00*** | (2006.01) |
| ***A63F 3/00*** | (2006.01) |
| ***G07F 17/32*** | (2006.01) |
| *A63F 9/24* | (2006.01) |

(52) U.S. Cl.

CPC ..... *A63F 5/0094* (2013.01); *A63F 1/00* (2013.01); *A63F 3/00157* (2013.01); *G07F 17/326* (2013.01); *A63F 2009/2442* (2013.01); *A63F 2009/2457* (2013.01); *G07F 17/3288* (2013.01); *G07F 17/3293* (2013.01)

(58) Field of Classification Search

CPC ..... A63B 71/00; A63F 1/18
USPC ..... 273/142 H; 463/17, 19, 20
See application file for complete search history.

(56) References Cited

U.S. PATENT DOCUMENTS

| | | | | |
|---|---|---|---|---|
| 4,732,386 A * | 3/1988 | Rayfiel | A63F 3/0625 | 273/142 H |
| 5,184,821 A * | 2/1993 | Korenek | A63F 5/04 | 273/138.2 |
| 6,878,064 B2 * | 4/2005 | Huang | G07F 17/3293 | 463/16 |
| 6,890,255 B2 * | 5/2005 | Jarvis | G07F 17/32 | 463/17 |
| 7,500,672 B2 * | 3/2009 | Ho | A63F 1/12 | 273/149 R |
| 7,527,265 B1 | 5/2009 | Berman | | |
| 7,553,233 B2 * | 6/2009 | Jarvis | G07F 17/32 | 463/17 |

(Continued)

*Primary Examiner* — Aarti B Berdichevsky
*Assistant Examiner* — Dolores Collins
(74) *Attorney, Agent, or Firm* — McDermott Will & Emery LLP

(57) ABSTRACT

Two modified roulette wheels are used to generate a pair of cards for a card game. Players may wager on one or more outcomes selected from a group of predetermined outcomes including one of the wheels producing a winning card value, the wheels producing equal card values, one or more of the wheels producing a card value below a first predetermined value, and one or more of the wheels producing a card value above a second predetermined value. The wheels are spun to produce one or more game outcomes from the group of predetermined outcomes, and the wagers are settled.

19 Claims, 7 Drawing Sheets

(56) References Cited

U.S. PATENT DOCUMENTS 7,753,374 B2 * 7/2010 Ho ..... A63F 1/12 273/149 R
7,901,280 B2 * 3/2011 Jarvis ..... G07F 17/32 463/17
7,926,808 B1 * 4/2011 Gullotta ..... A63F 5/007 273/142 F
8,100,754 B2 * 1/2012 Bigelow, Jr. ..... G07F 17/32 463/16
8,152,171 B2 * 4/2012 Miltenberger ..... A63F 5/00 273/142 E
8,622,808 B2 * 1/2014 Pececnik ..... G07F 17/3202 463/16
8,727,862 B2 * 5/2014 Jarvis ..... G07F 17/32 463/17
8,777,727 B2 * 7/2014 Jones ..... A61K 9/12 463/11
8,851,972 B2 * 10/2014 Rodgers ..... G07F 17/34 463/16
2004/0077398 A1 * 4/2004 Jarvis et al. ..... 463/17
2007/0057452 A1 3/2007 Dargue
2009/0189351 A1 * 7/2009 Baerlocher et al. ..... 273/309
2011/0218027 A1 * 9/2011 Manz et al. ..... 463/19
2012/0094734 A1 4/2012 Fisher et al.
2012/0112408 A1 * 5/2012 Poon ..... A63F 5/045 273/142 R
2012/0238343 A1 * 9/2012 Perrone ..... G07F 17/3262 463/17
2013/0136702 A1 * 5/2013 Wiedmann et al. ..... 424/43
2013/0137501 A1 * 5/2013 Jones ..... 463/20
2013/0143640 A1 * 6/2013 Young ..... 463/20
2013/0203477 A1 * 8/2013 Manning et al. ..... 463/17
2013/0307216 A1 * 11/2013 Jones ..... A63F 1/12 273/149 R
2014/0106841 A1 * 4/2014 Lutnick et al. ..... 463/17
2014/0203504 A1 * 7/2014 Macdonald ..... 273/142 E
2014/0302909 A1 * 10/2014 Meyer ..... 463/20
2014/0319769 A1 * 10/2014 Macdonald et al. ..... 273/142 E

* cited by examiner

TWO-WHEEL ROULETTE GAME

CROSS-REFERENCE TO RELATED APPLICATION

The present application claims the benefit of U.S. Provisional Patent Application Ser. No. 61/758,736, entitled "Two Wheel Roulette Apparatus," filed on Jan. 30, 2013, which is hereby incorporated by reference in its entirety for all purposes.

BACKGROUND

The outcomes of various games, including casino games, may be decided according to one or more variables. In the game of roulette, a wheel is spun in one direction, and a ball in the opposite direction around a tilted circular track running around the inner circumference of the wheel. The ball eventually loses momentum and falls into one of a number of colored and numbered compartments on the wheel. However, for a time before the ball loses velocity, players may place wagers on where the ball will eventually end up. For example, a player may bet that the ball will land in a compartment for a specific number, color, or whether the number is going to be an odd or an even number. The game administrator (e.g., croupier or dealer) is responsible for stopping the betting before the ball loses velocity so that the players cannot estimate when or where the ball will fall.

SUMMARY

The disclosed subject matter relates to a method for playing a roulette-based card game, the method comprising providing at least two random number generators, providing for user selection a plurality of game plays, each game play being for at least one game outcome, receiving a selection of at least one of the plurality of game plays, activating the at least two random number generators to produce at least two respective game values, and upon the random number generators producing the at least two respective game values, identifying if one or more game outcomes exist based on the produced at least two respective game values and the selected at least one game plays. Other aspects include corresponding systems, apparatuses, and computer program products for implementation of the computer-implemented method.

In another aspect, a system may comprise a display screen configured to display a user interface, and game circuitry. The game circuitry may be configured to provide for display at the display screen multiple simulated game wheels, each game wheel, when activated, being configured to spinning a ball around a circumference of the wheel until it lands in one of a plurality of compartments representative of a plurality of respective playing cards, provide for selection a plurality of game outcomes simulate a spin of the game wheels to produce one or more game outcomes from a group of outcomes comprising one of the game wheels producing a winning highest ranking card of the game wheels, the game wheels producing a pair of cards, one or more of the game wheels producing a card having a rank below a first predetermined value, and one or more of the game wheels producing a card having a rank above a second predetermined value and simulate a spin of the game wheels to produce one or more of the plurality of game outcomes. Other aspects include corresponding apparatuses, and computer program products for implementation of the computer-implemented method.

In a further aspect, a device for using in a card game may be configured to provide a display of two random card generators, each card generator, when activated, producing one of a predetermined number of cards, receive the one or more wagers from one or more players, each wager for an outcome selected from provide a group of predetermined selectable outcomes comprising one of the card generators producing a winning card, the card generators producing cards having equal ranks, one or more of the card generators producing a card having a rank below a first predetermined value, and one or more of the card generators producing a card having a rank above a second predetermined value, receive one or more wagers from one or more players, each wager for one of the selectable outcomes, after receiving the one or more wagers, activate the card generators to produce one or more game outcomes from the group of predetermined selectable outcomes, and settle the one or more wagers according to the one or more game outcomes.

It is understood that other configurations of the subject technology will become readily apparent from the following detailed description, where various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

Certain features of the subject technology are set forth in the appended claims. However, for purpose of explanation, several implementations of the subject technology are set forth in the following figures.

DETAILED DESCRIPTION

Figure 1:
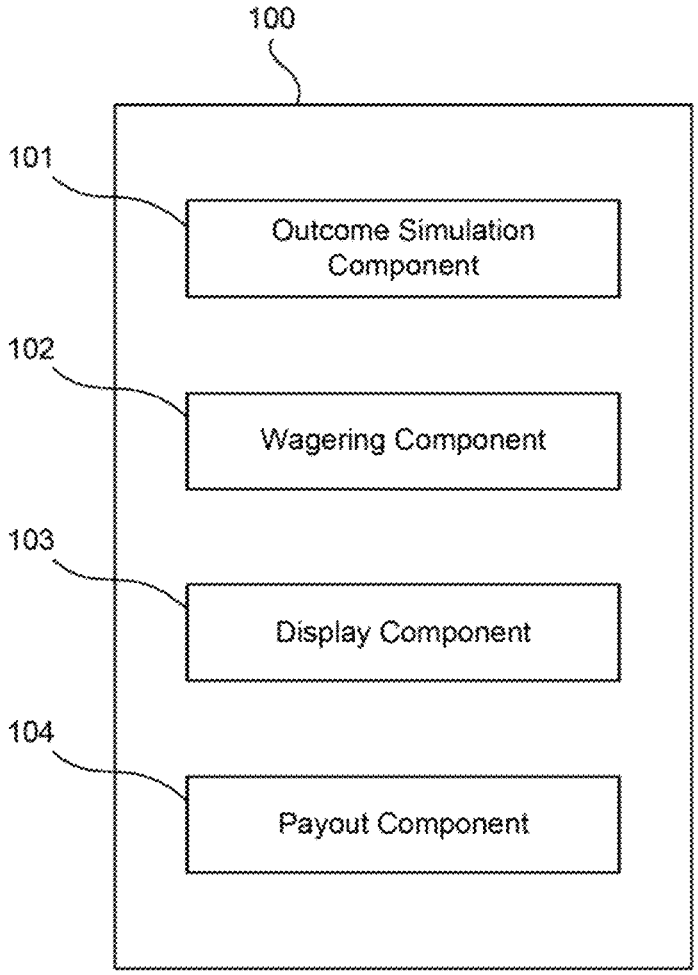
FIG. 1 illustrates an example apparatus for simulating play of an example card game.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent that the subject technology is not limited to the specific details set forth herein and may be practiced without these specific details.

The subject disclosure provides various mechanisms for playing a card game. In one or more implementations, the card game is played by one or more players and an opponent (e.g., a banker, croupier, dealer, game administrator, the "house," or the like). The players may play the game physically at a playing table, or may play the game using one or more electronic devices. According to various implementations, the game is played using one or more random number generators. A random number generator may be a random card generator, which generates one of a number of predetermined cards each having associated with it at least a value and/or suit. Each card generator may produce one card value (e.g., rank and suit) from a predetermined number of card values. A card produced by a card generator may also be associated with an image or symbol. When multiple random number generators are used in a game, each random number generator used in a game may be the same or may be different from the other.

In one or more implementations, a card generator may be, for example, a roulette wheel modified such that each compartment of the wheel represents a card value. In some implementations, a card generator may be a computer or other electronic device that randomly generates a card value. In some implementations, a random card generator may include a random number generator and a random non-number generator. Accordingly, a random card generator may be configured to generate a card suit, a non-number image, and/or a numerical value. In some implementations, a random card generator may be a dealing shoe storing randomly shuffled cards.

To play an example game, one or more wagers are received from one or more players participating in the game. Each wager is for an outcome selected from a group of predetermined outcomes comprising one of the card generators producing a winning card value, the card generators producing equal card values, one or more of the card generators producing a card value below a first predetermined value, and one or more of the card generators producing a card value above a second predetermined value. For example, a player may wager that a first card generator will produce the winning card and a second card generator will produce a card having a rank lower than seven (e.g., ace, two, three, four, five, or six). After the one or more wagers are received, the card generators are activated to produce one or more game outcomes from the group of predetermined outcomes, and the wagers settled according to the one or more game outcomes.

In one or more implementations a game according to the subject technology includes two game wheels. Unlike classic roulette wheels, each game wheel may have thirty-nine (39) compartments. Moreover, the compartments on each wheel may further be visually divided into three groups of thirteen. Each group may be associated with a non-number symbol or image (e.g., Chinese characters, playing card suits), and each compartment within the group may be associated with a card rank or value (e.g., 1, 2, 3, 4, 5, 6, 7, 8, 9, 10, J, Q, K, and A). In some embodiments, each wheel may be associated with a theme (e.g., Dragon, Tiger).

An example card game may involve spinning the two wheels simultaneously, and wagering on any possible combination of wheel, group, and compartment. A player may wager on, for example, a theme or symbol displayed by a wheel (e.g., the winning wheel), or rank of a card displayed by the wheel. Additionally or in the alternative, a player may wager on the two wheels resulting in a pair. A player may also wager on the combined values of the two wheels being above, below, or at a certain value. In some implementations, wagers may be placed on a variation or combination of roulette and playing card rules.

The term "game" or "games" as used herein encompasses various opportunities for a player (or "user") to wager on the results or outcome of an event, and/or on a specific occurrence. For example, in a card game the event may be a dealing and/or revealing of one or more cards to the player(s), the opponent, or both. The outcome may be associated with odds that the cards will be dealt in one of multiple combinations to a player, the opponent, or both, and further may be associated with a payout payable on the occurrence of the wagered event. In one example, the payout may be calculated based on the amount of the wager and/or the odds. Odds of winning the wager and/or the payout of a bet placed on a game may also be dependent on or independent from the number of players in the game. In one example, any number of players wagering on the game may be personally located at the game and/or may place a wager remotely according to the processes described herein.

In some implementations, the card games of the subject technology are conducted in real-time and in a physical setting (e.g., operated by or affected by physical entities such as other players, dealers, operators physically present), for example, at a play table in a casino. A live game may be distinct from a virtual game occurring in the virtual world. Live games and virtual games may include single player or multi-player games, where one or more players may simultaneously place wagers on one or more possible outcomes of the game. While the subject technology may be described herein with respect to a virtual game using one or more apparatus or electronic devices, it is understood that the various features and/or game rules described may also be performed live by players that are physically at a playing table.

FIG. 1 illustrates an example apparatus 100 for simulating play of an example card game according to one or more implementations of the subject technology. The various components of the apparatus 100 may be implemented as a processor-based game console. For example, apparatus 100, may be a single console or terminal for allowing a single player to play a virtual card game, with the game being simulated by software or firmware executing on apparatus 100. Apparatus 100 may be implemented in a single cabinet, or multiple cabinets, or as a live play table. Apparatus 100 may be a game console for remote participation in a live table game. In one or more implementations, apparatus 100 is a made up of multiple stations or terminals allowing multiple players to play a card game at a live table or being simulated by the apparatus 100, including for example, each player wagering on one or more potential game outcomes.

In one or more implementations, apparatus 100 may be a client device in a client-server environment, including a client application for playing the card game in a virtual environment. In this manner, the client application may be installed at apparatus 100 and/or otherwise accessible at apparatus 100 by a user (e.g., through a browser or web-enabled component application installed on apparatus 100). Apparatus may be a mobile device (e.g., a smart-phone or notebook or tablet computer). The user may download the application onto apparatus 100 and/or access the application using a browser installed at apparatus 100.

Apparatus 100 includes game circuitry, which implements one or more of an outcome simulation component 101, a wagering component 102, and a display component 103. One or more components of apparatus 100 may be communicatively coupled to each other via wired or wireless connection. Outcome simulation component 101 may include one or more randomizer units in one or more sets, for simulating one or more game outcomes (e.g., outcomes that players can wager on). Outcome simulation component 101 may include an electronic random number generator for facilitating selection of a set of cards used in a card game. The electronic random number generator may generate, for example, random numbers and suits corresponding to cards in the deck. On selection of a card from the deck the number for the card and suit may be removed from being regenerated by the random number generator. Outcome simulation component 101 may include other randomization mechanisms, for example, one or more of spinning mechanisms, rotation mechanisms, and vibration mechanisms for generating a randomized set of values for selection of a randomized set of cards from a virtual deck.

Outcome simulation component 101 may select one or more cards from one or more predetermined virtual decks according to a predetermined rule. Each deck may include a predetermined number of cards of a certain suit or values. For example, a deck of cards may include fifty-two standard playing cards of four different suits. In various aspects, jokers may be omitted from the deck. The total number of cards selected for a card game may be based on a predetermined value, for example, set by a game administrator or sponsor of the game (e.g., by a casino). Additionally or in the alternative, apparatus 100 may be operably connected to one or more game wheels modified to generate card values as an outcome of a spin. In this respect, outcome simulation component 101 may receive one or more card selections from the wheel(s) and present the card selections to other components of apparatus 100 as if outcome simulation component 101 generated the card selections.

Figure 2:
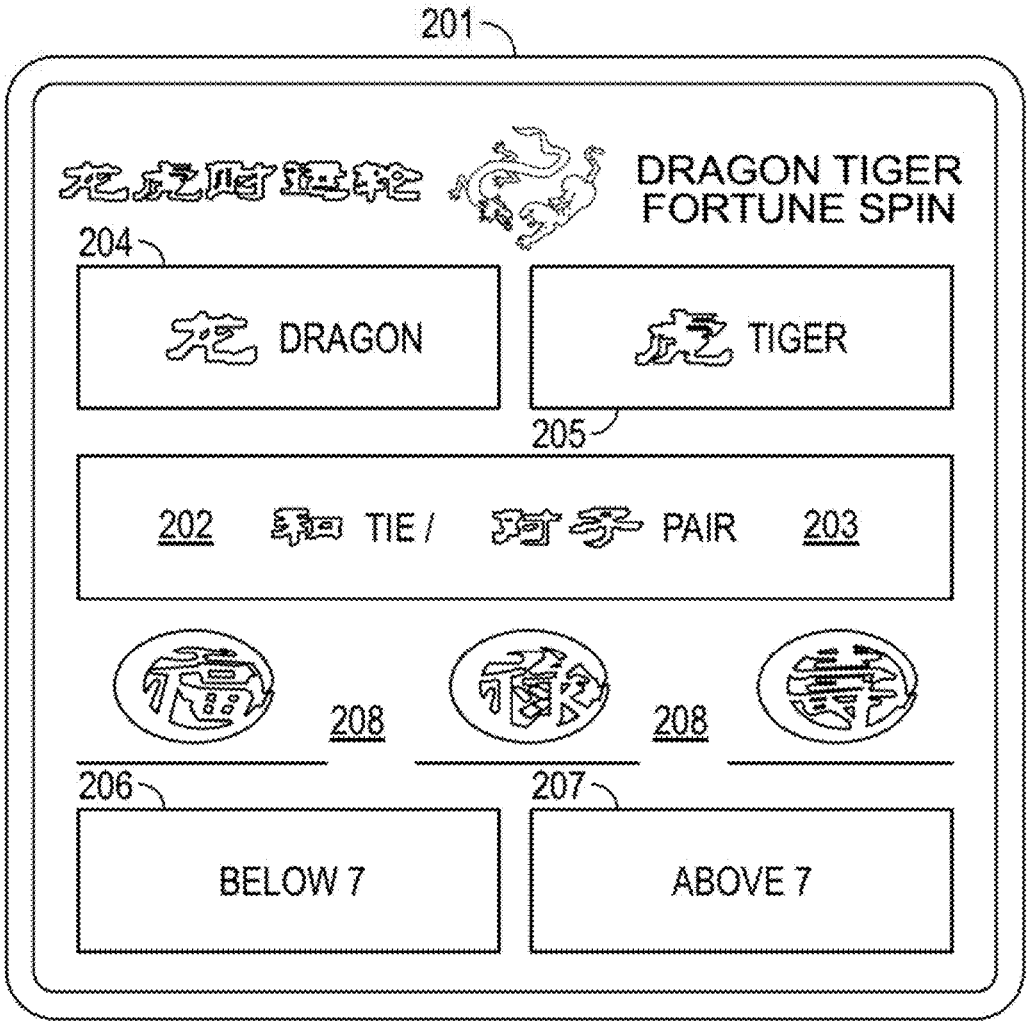
FIG. 2 illustrates an example player wager area for a player of the example card game.
Figure 3:
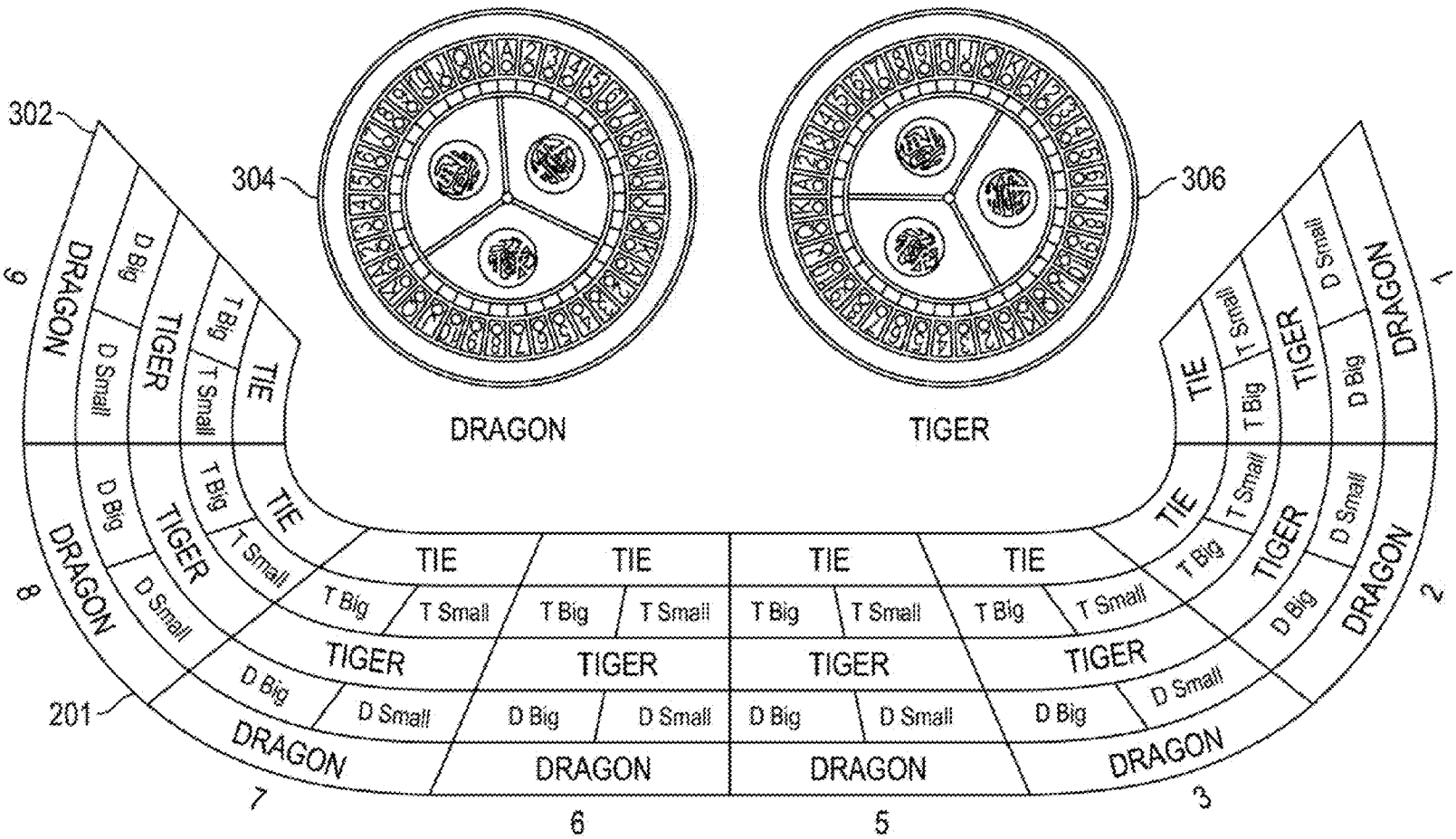
FIG. 3 illustrates an example gaming system, including an example playing table and two game wheels modified to generate card values as an outcome of a spin.

Wagering component 102 may include or be associated with one or more wagering mechanisms for facilitating placing wagers on the possible outcomes of cards selected by outcome simulation unit 101. In some implementations, the wagering mechanisms may, for example, include one or more of machine implemented buttons, one or more touch screens or portions thereof, and/or include other machine-implemented mechanisms for selection of game plays (including placement of wagers on potential outcomes for a game), initiating the dealing of a new set of cards, initiating rounds of play, and/or otherwise taking part in a game or round of play of the game simulated using apparatus 100. FIG. 2 and FIG. 3 illustrate various examples of a user interface for providing information about a virtual card game to a player and/or facilitating play of the card game by way of virtual wagering mechanisms implemented on a touch screen. Accordingly, these virtual wagering mechanisms may enable a single player to place wagers on potential outcomes related to cards generated by outcome simulation component 101 and/or selected by the player.

If the user is a new player, the user may be requested to provide information such as name, contact information, gaming preferences, and/or financial banking information. Such information may be used to create a user account used to conduct wagers for the card game. The account may be maintained in accordance with applicable requirements, rules and/or regulations for gaming and/or financial accounts.

Display component 103 may include one or more displays for providing game-related information and graphics to the player. For example, display component 103 may include a main display for displaying game information such as game outcomes, wagering results, a visual representation of the randomizer unit(s) of the outcome simulation component 101, information and data from the outcome simulation component 101, and/or wagering information from the wagering component 102. Wagering component 102 and main display of display component 103 may be implemented as a user interface for display of the player wager areas depicted in FIG. 2 and/or FIG. 3. In one or more implementations, display component 103 may include touch screen capabilities for allowing a player to place wagers.

In various aspects, display component 103 may include one or more secondary displays for displaying various images, videos or other visual indicia relating to the game, advertisements, marketing material, or other visual images or videos for display to the player. The main display and/or secondary display may include one or more of a touch screen display, a panel, a holographic display, a screen (e.g., LED or LCD) or other display. One or more displays of display component 103 (e.g., the main display or secondary displays) may include a tablet or other mobile display mechanism operably connected to apparatus 100 and used by the player.

Payout component 104, in one example, may be configured to settle wages placed, for example, using the wagering component 102, according to the outcome generated, for example, by the outcome simulation component 101. In one example, the wagering component may have access to data regarding particular returns for particular wagers relating to a specific game. In some examples, the payout component may further have access to rules and/or regulations regarding settling of wagers and/or payouts in one or more games. In one or more implementations, payout component 104 may include or be operably connected to a physical payout dispenser or distributor for distribution of game tokens to the player(s).

FIG. 2 illustrates an example player wager area 201 for a player of the example card game according to one or more implementations of the subject technology. Player wager area 201 includes multiple regions for placement of wagers by one or more players on various outcomes of the example card game. Accordingly, placement of one or more game tokens in one of the displayed regions of player wager area 201 indicates a wager (in the amount of the game tokens) on the outcome represented by the region wherein the tokens were placed. Player wager area 201 may be implemented in connection with one or more live playing tables in a casino, or in connection with virtual tables in a virtual game. For example, player wager area 201 may be displayed by display component 103 of apparatus 100 to one or more players.

In various implementations, one or more card generators generate game outcomes, the possibilities of which are wagered on using player wager area 201. While various types of card generators may be used, including manual shuffling and dealing by a game administrator from a dealing shoe, game outcomes for player wager area 201 are described as using two game wheels to generate card values. Each wheel has thirty-nine (39) compartments divided into three groups, with each group including a compartment for each card value in a deck of cards (e.g., having compartments numbered ace, two, three, four, five, six, seven, eight, nine, ten, jack, queen, and king). Other game wheel configurations are possible, and one or more of the wheels may be replaced such that the game is played, for example, with one wheel and a card generator of a different type.

In the depicted example, a wager placed in a "tie" region 202 indicates a wager on an outcome that the two wheels will produce the same card value (e.g., rank and/or suit). A wager placed in a "pair" region 203 indicates a wager on an outcome that the two wheels will produce cards of the same rank or suit. A wager placed in a first region 204 associated with a first wheel (e.g., labeled "Dragon") indicates a wager on an outcome that the first wheel will produce the highest card value. A wager placed in a second region 205 associated with a second wheel (e.g., labeled "Tiger") indicates a wager on an outcome that the second wheel will produce the highest card value. Player wager area 201 may include regions 206 and 207 for wagers on an outcome that one or both wheels will produce a card value (e.g., rank) above or below, respectively, a predetermined value.

As described previously, each game wheel may be divided into multiple sections, with each section represented by a non-number symbol. Accordingly, player wager area 201 may also include matching symbols regions 208 that correspond to sections of the wheel. In one or more implementations, one or more players may wager that the highest card value displayed by a wheel will be associated with a particular section. If a player wagered on the winning wheel, and wagered on the winning symbol region, then the player's wager for the symbol region may be paid out based on a predetermined payout ratio for the wager (e.g., based on odds set by the casino or statistics). Player wager area 201 may provide for other types of wagering using the symbols or sections of the wheel(s). For example, one or more players may wager that both wheels reveal the same symbol or section. Player wager area 201 may include an additional wheel designation for the symbols so that the player(s) may wager that an outcome will include a card value for a particular wheel be associated with the symbol or section irrespective of whether the player(s) chose the winning wheel.

In one or more implementations, player wager area 201 may be displayed on a touch sensitive display screen operable for direct interaction with one or more virtual controls. For example, each region of player wager area 201 (e.g., tie, win, and the like) may be touched by a player to indicate placement of a wager in the region. The player may then place the wager by using other virtual controls associated with manipulating virtual currency. For example, player wager area 201 may further include a game token supply region in which virtual game tokens available for game play by the player are depicted. In one or more implementations, the player may initiate a wager by selection of one or more game tokens and dragging the game tokens into an appropriate region of player wager area 201.

It also understood that the regions of player wager area 201 may be controlled by one or more associated hardware controls such as a keyboard, mouse, trackball, voice recognition/activation module, or other devices suitable for interaction with virtual items displayed on the user interface associated with player wager area 201. In one example, apparatus 100 may display player wager area 201 and one or more virtual controls in a user interface outside the area depicted by player wager area 201. In one or more implementations, the controls may be physical/mechanical buttons.

FIG. 3 illustrates an example gaming system 300, including an example playing table 302 and two game wheels modified to generate card values as an outcome of a spin. According to one or more implementations, playing table 302 may include multiple player wager areas 201 located around one or more card generators. In the depicted example, playing table 302 includes nine player wager areas 201, and is located proximate to a first game wheel 304 and a second game wheel 306 for generating card values. It is understood, that playing table 302 may include one, two, three, or any number of player wager areas 201, and that the wager areas may include other wager regions or configurations than those depicted. One or both of the depicted game wheels may be replaced by other types of card generators, including one or more decks of card shuffled and dealt by a game administrator, without limitation.

Player wager areas 201 of playing table 302 may be contiguous or separated from each other. In a virtual game, each player wager area 201 may be displayed on a respective player device, and a representation of playing table 302 optionally displayed by assembling the component wager areas from each player. In one example, each player device may display a player wager area 201 and a playing table 302 in which the wager area is depicted with other wager areas for other players may be displayed on a display viewable by all the players (e.g., on a large video screen in the casino above the game wheels).

In one or more implementations, a live table game may have one or more remote seats operably connected to respective gaming consoles via video, audio and/or one or more other electrical signals. Accordingly, one or more player wager areas 201 may be displayed at an interactive gaming console (e.g., implemented by apparatus 100) remotely situated from the live table game. A user of the console may make wagers remotely using the console, and view outcomes of the live table game, for example, on a display screen of the console.

In the depicted example, first and second game wheels 304 and 306 include an interior track or groove around interior circumference of the wheel. A ball may travel along the track, spinning around the interior circumference. In the depicted example, each game wheel includes thirty-nine separate compartments 308, with each compartment configured to confine the ball after the ball has completed spinning around the interior track. The compartments may be on a separate portion, or "platter," of the game wheel that spins, for example, in an opposite direction than the ball. Each compartment is marked with a card value for the compartment. Each game wheel is further divided into three equal sections, each marked with a unique symbol. First game wheel 304 is marked "Dragon Wheel" and second game wheel 306 is marked "Tiger Wheel" so that the card values generated by the respective wheels may be associated with corresponding marked regions of playing table 302.

Each compartment may be configured with a compartment sensor that detects when the ball has come to a rest within the compartment. Using the compartment sensors, a final resting location for the ball (after being launched around the inner circumference of the wheel) may be recorded and communicated to game circuitry associated with apparatus 100 or other device so that wagers placed in game area 201 may be reconciled with the outcomes of the respective wheels.

With further reference to FIG. 3, a game may begin by the game administrator announcing that wagers may be placed. Players may then place game tokens in the various regions of their wager area to indicate a wager on one or more outcomes of a spin of the game wheels. In one or more implementations, the "Dragon" wheel is spun first, followed by the "Tiger" wheel. In the depicted example, the card value resulting from the first spin is associated with the "Dragon" areas of the playing table, and the card value resulting from the second spin is associated with the "Tiger" areas of the playing table. In some implementations, the wheels may be spun simultaneously and the card value from the wheel providing the first result being associated with the "Dragon" areas, and the card value from the wheel providing the second (subsequent) result being associated with the "Tiger" areas. In some implementations, each wheel may have a "Dragon" or "Tiger" designation such that the cards values produced from each wheel are automatically assigned to their respective areas.

Each card value generated by a wheel (or other card generator) is deemed a hand, and the winning hand is the hand of the highest ranking card. Suits may not be ranked. If both hands have the same rank or value then the round of play is considered a tie. In one or more implementations, a predetermined number may be set to distinguish between "Big" and "Small" ranks or values for a hand. For example, if the predetermined number is seven then a rank of eight or higher is considered "Big" and a rank of six or lower is considered "Small."

Wagers may be placed on any combination of the foregoing possible game outcomes, and the game administrator may settle wagers at the end of each round of play when the results from both wheels have been announced. An example settlement for a wager that correctly predicted a tie may include a payout of eleven-to-one, while incorrectly predicting a tie may include a loss of fifty-percent of the wagered amount. A settlement for correctly predicting a winning hand (e.g., "Dragon win" or "Tiger win") or predicting a "Big" or "Small" may include a payout of one-to-one.

The specific visual arrangement described in FIG. 3 is used for exemplary purposes. It should be understood that any number of visual arrangements are possible for a given set of game rules. Moreover, any mechanism facilitating input from a user may be used to receive player input. Furthermore, it should be understood that various elements (e.g., regions) of the displayed player wager area 201 may be moved, rearranged, and/or modified.

Figure 4:
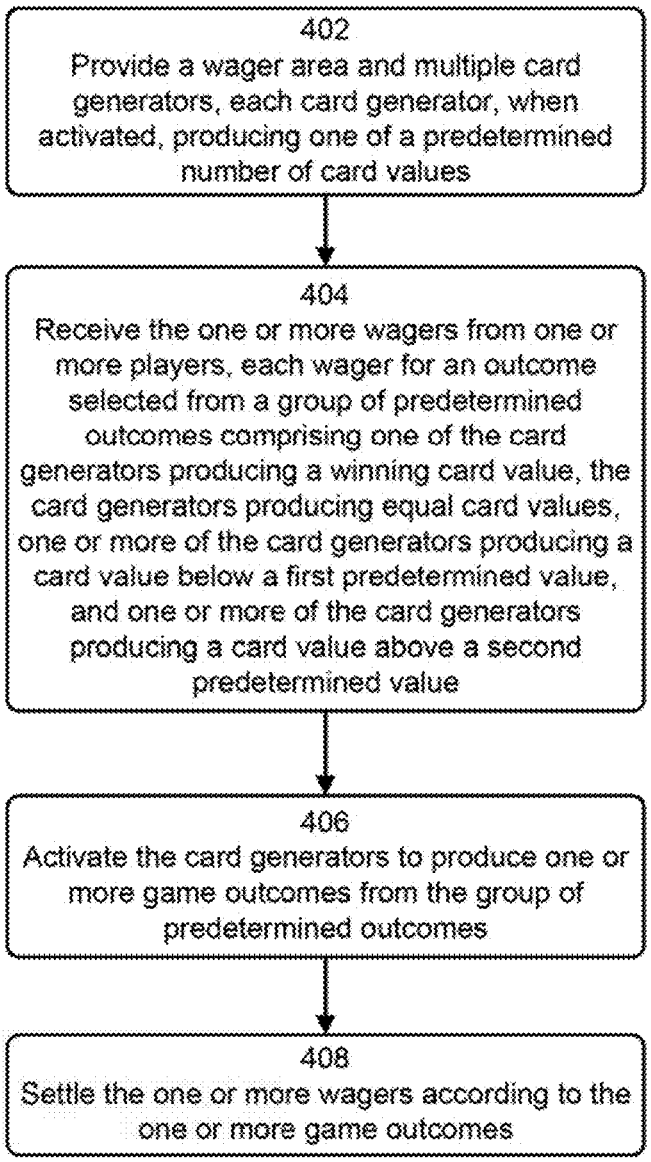
FIG. 4 illustrates a flow diagram of an example process for facilitating play of an example card game.

FIG. 4 illustrates a flow diagram of an example process 400 for facilitating play of an example card game in accordance with one or more implementations. For explanatory purposes, example process 300 is described herein with reference to components of apparatus 100 and player wager area 201; however, example process 400 is not so limited.

Example process 400 may be performed by game circuitry of apparatus 100. Similarly, a non-transitory machine-readable medium may include machine-executable instructions (e.g., software) thereon that, when executed by a machine or computing device perform the blocks of FIG. 4. In some aspects, process 400 or portions thereof may be implemented by one or more individual players interacting with a game administrator or other game administrator in a live environment (e.g., in a casino). Further for explanatory purposes, the blocks of example process 400 are described herein as occurring in serial, or linearly. However, multiple blocks of example process 400 may occur in parallel. In addition, the blocks of example process 400 need not be performed in the order shown and/or one or more of the blocks of example process 400 need not be performed.

In a card game according to the subject technology, a wager area 201 and multiple random card generators are provided (402). The card generators may be implemented by, for example, outcome simulation component 101. Each card generator, when activated, produces one of a predetermined number of card values, and the wager area facilitates selection of one or more game plays, including wagering on possible outcomes of the card game. At least one of the card generators may be a game wheel configured such that each compartment of the game wheel represents one of the card values. For example, the card game may include a first game wheel 304 and a second game wheel 306. At least one card generator may include a random number generator and a random non-number generator, and be configured to generate a card suit, a non-number image, and/or a numerical value. Additionally or in the alternative, one or more game wheels may be a dealing shoe storing randomly shuffled cards. Other types of card generators may also be included.

One or more wagers are received from one or more players (404), each wager for an outcome selected from a group of predetermined outcomes. The wagers may be placed on one or more regions of player wager area 201 for one or more players. The group of predetermined outcomes may include, for example, one of the card generators producing a winning card value, the card generators producing equal card values, one or more of the card generators producing a card value below a first predetermined value, and one or more of the card generators producing a card value above a second predetermined value. The first and second predetermined values may be the same or different. For example, the group of predetermined outcomes may include that a card value is above or below the number seven.

The card values may be divided into multiple sections (or designations) such that each card value is associated with one of the multiple sections (or designations). In this regard, the group of outcomes may further include one or more of the card generators producing a card value associated with a preselected one of the sections, and each card generator producing a card value associated with the same section. The card values may be divided into three sections. The predetermined number may be thirty-nine, with each section including thirteen card values ranked ace, two, three, four, five, six, seven, eight, nine, ten, jack, queen, and king. Where one or more of the card generators are a game wheel, each compartment of the game wheel may represent one of the card values, with each compartment being associated with one of the three sections.

After receiving the one or more wagers, the card generators are activated to produce one or more game outcomes from the group of predetermined outcomes (406). If the card generator is a game wheel, the wheel may be activated by initiating a spin of the wheel to produce a card value. If the card generator is a dealing shoe storing randomly shuffled cards then the shoe may be activated by a dealing of a card representative of a card value. Upon the card generators producing at least two card values, one or more game outcomes are identified based on the produced card values and game plays selected by the player(s).

The one or more wagers are settled according to the one or more game outcomes (408). In live games, the game administrator may place a winning area marker on the winning region(s) of wager area 201 and then manually disperse winnings to the players who have game tokens (wagers) placed in those regions. In a live game with multiple players, or in a virtual game, the settling of wagers may be automatically handled by game circuitry of apparatus 100. Accordingly, a marker may appear in the winning regions of each wager area displayed at each player terminal (e.g., a client device that includes an interactive display screen), and a payout displayed in payout area 103 and/or automatically dispensed by a payout dispenser associated with the winning player terminal.

Many of the above-described example process 400, and related features and applications, may be implemented as software processes that are specified as a set of instructions recorded on a computer readable storage medium (also referred to as computer readable medium). When these instructions are executed by one or more processing unit(s) (e.g., one or more processors, cores of processors, or other processing units), they cause the processing unit(s) to perform the actions indicated in the instructions. Examples of computer readable media include, but are not limited to, CD-ROMs, flash drives, RAM chips, hard drives, EPROMs, etc. The computer readable media does not include carrier waves and electronic signals passing wirelessly or over wired connections.

In this specification, the term "software" is meant to include, where appropriate, firmware residing in read-only memory or applications stored in magnetic storage, which can be read into memory for processing by a processor. Also, in some implementations, multiple software aspects of the subject disclosure can be implemented as sub-parts of a larger program while remaining distinct software aspects of the subject disclosure. In some implementations, multiple software aspects can also be implemented as separate programs. Finally, any combination of separate programs that together implement a software aspect described here is within the scope of the subject disclosure. In some implementations, the software programs, when installed to operate on one or more electronic systems, define one or more specific machine implementations that execute and perform the operations of the software programs.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g. files that store one or more modules, sub programs, or portions of code). A computer program can be deployed to be executed on one computer or on multiple computers that are located at one site or distributed across multiple sites and interconnected by a communication network.

Figure 5:
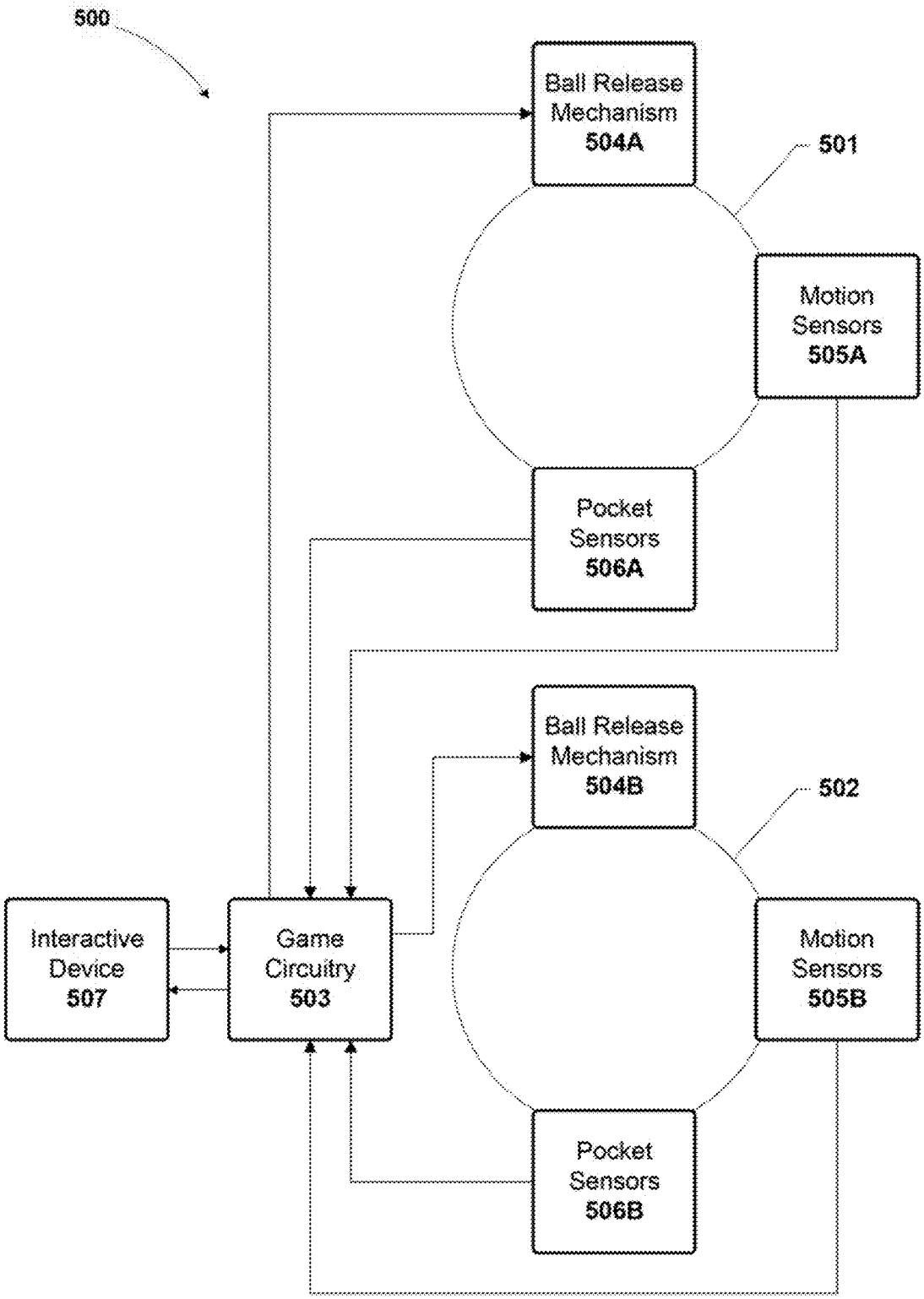
FIG. 5 illustrates an example component diagram for playing an example card game using two example game wheels.

FIG. 5 illustrates an example component diagram for playing an example card game using two example game wheels, according to one or more aspects of the subject technology. A system 500 includes a first game wheel 501, second game wheel 502, and game circuitry 503. As described previously, game wheels 501 and 502 function as card generators to provide two card values which may be used to generate various outcomes in the example card game. System 500 may further include one or more components operably connected to game wheels 501 and 502 and game circuitry 503, including respective ball release mechanisms 504A and 504B for each wheel, respective ball motion sensors 505A and 505B for each wheel, and respective compartment sensors 506A and 506B for each wheel.

As described previously, each game wheel includes a plurality of compartments, with each compartment being for stationary confinement of a ball. Each compartment includes a respective one of compartment sensors 506A or 506B configured to detect when the ball has come to a rest and is positioned within the compartment, and to communicate that the ball has come to rest and/or an identification of the final compartment location to game circuitry 503. Game circuitry 503 may be configured to communicate that the ball came to a rest and the result to various components of apparatus 100 without game administrator involvement.

System 500 may also include an interactive device 507 for providing alerts to the players of the game, and/or the game administrator. Interactive device 507 may be, for example, a touch screen display that also provides visual feedback of game activities. In one or more implementations, interactive device 507 may be a touchscreen that visually depicts the buttons for operation of game wheels 501 and 502. For example, interactive device may include buttons for activating release mechanisms 504A and 504B. In this regard, the launching of the ball may be triggered manually by the game administrator by activating the appropriate button. In some implementations, the ball may be launched manually by the game administrator.

One or more motion sensors 505, in connection with game circuitry 503, may be configured to track the ball as it moves around game wheel 501 and/or the revolutions of the wheel. In one or more implementations, game rules may require that each wheel and/or ball complete a predetermined number of full revolutions to constitute a valid spin (e.g., three revolutions). Sensors 505 may be configured to send a signal to game circuitry 503 and/or interactive device 507 indicating when the wheel and/or ball has made the predetermined number of revolutions, or the velocity of the ball or game wheel drops below a predetermined threshold velocity. A message may then be displayed on interactive device 507 or on a players user interface (via display component 103) informing the players that the game wheel has a valid spin an/or that no more wagers may be made.

Figure 6:
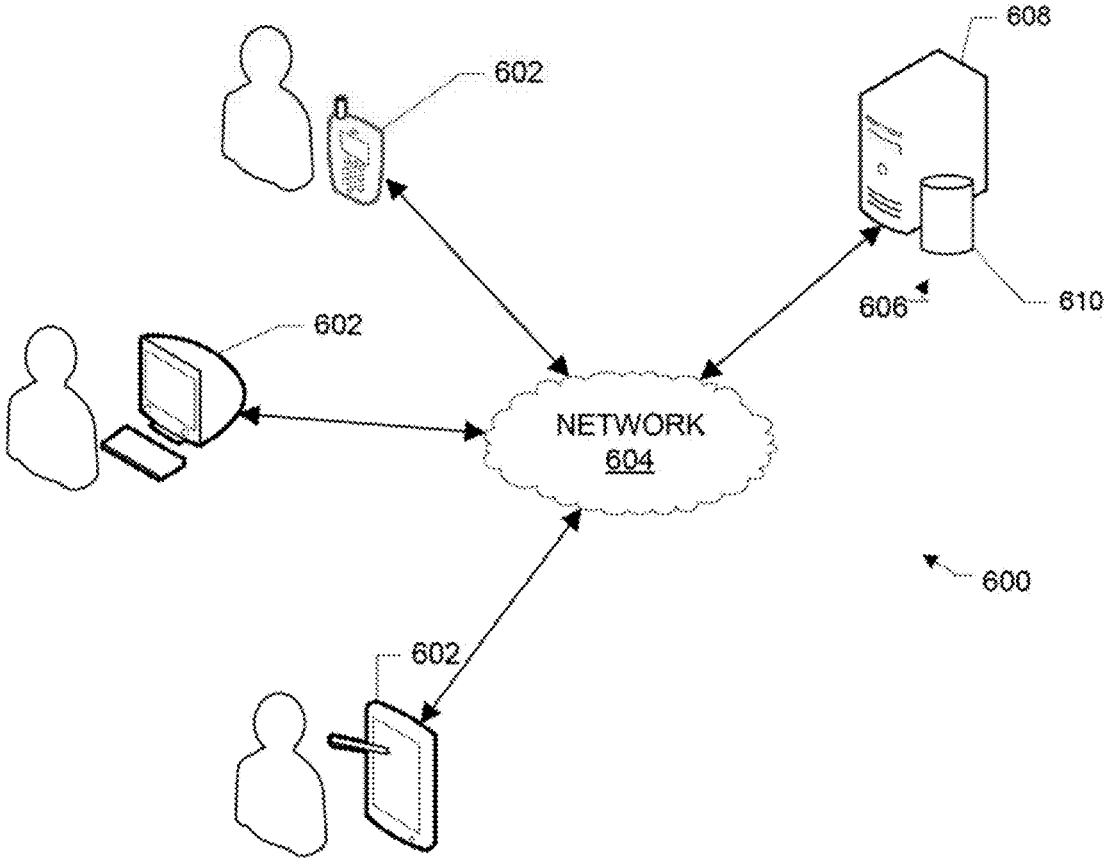
FIG. 6 illustrates an example client-server network environment, which provides for facilitating one or more virtual card games.

FIG. 6 illustrates an example client-server network environment, which provides for facilitating one or more virtual card games in accordance with one or more implementations of the subject technology. A network environment 600 includes a number of client devices 402 communicably connected to one or more servers 606 by a network 604. In some example implementations, client devices 602 can be computing devices such as general purpose computers including laptop or desktop computers, portable computing devices, smartphones, PDAs, portable media players, tablet computers, or other appropriate computing devices. In the example of FIG. 5, three electronic devices are depicted, including a smartphone, a desktop computer, and a PDA.

In one example, the client devices 602 can be any computing device capable of communicating over a communication network. In one example, client devices 602 may be configured to access data from other storage media, such as memory cards or disk drives as may be appropriate in the case of downloaded services. Client devices 602 may include standard hardware computing components such as network and media interfaces, non-transitory computer-readable storage (memory), and processors for executing instructions that may be stored in memory.

In some implementations, server 606 includes one or more processing devices 608 and a data store 510. Processing device 608 executes computer instructions stored in data store 510, for example, to facilitate a virtual card game for one or more players (or "users") interacting with client devices 602. In one example, server 606 may provide one or more web pages and or other user interfaces for display to the players via client devices 602. In one or more implementations, server 606 provides a player wager area 201 and a representation of the associated card generators to each player. Server 606 may implement or facilitate implementation of the various blocks described by FIG. 4.

Players may interact with a virtual card game hosted by server 606 through a client application installed at a client device 602. The client application may be a web based browser application at the client devices 602. Upon opening or otherwise initiating a client application for the card game of the subject technology, client device 602 may communicate with the server 606 to determine what games are active, and what games are available to join. Once the player chooses a game, the client application may communicate with server 606 to display a player wager area 201 at the client device. Communication between client devices 602 and server 606 (including, e.g., processing device 608 and a data store 510), may be facilitated through network 604. Communications between the client devices 602 and server 606 may be facilitated through the various communication protocols (e.g., HTTP, XMPP).

In some example aspects, server 606 can be a single computing device such as a computer server. In other implementations, server 606 can represent more than one computing device working together to perform the actions of a server computer (e.g., cloud computing). Server 606 may be coupled with various remote databases or storage services. Accordingly, it should be understood that the functions performed by server 606 may be performed within a single server, or across multiple servers. Any of the aforementioned servers (or an integrated server) may take on certain client-side, cache, or proxy server characteristics. These characteristics may depend on the particular network placement of the server or certain configurations of the server.

Network 604 can be a public communication network (e.g., the Internet, cellular data network, dialup modems over a telephone network) or a private communications network (e.g., private LAN, leased lines). The network 608 can include, for example, any one or more of a personal area network (PAN), a local area network (LAN), a campus area network (CAN), a metropolitan area network (MAN), a wide area network (WAN), a broadband network (BBN), the Internet, and the like. Further, network 604 can include, but is not limited to, any one or more of the following network topologies, including a bus network, a star network, a ring network, a mesh network, a star-bus network, tree or hierarchical network, and the like.

Figure 7:
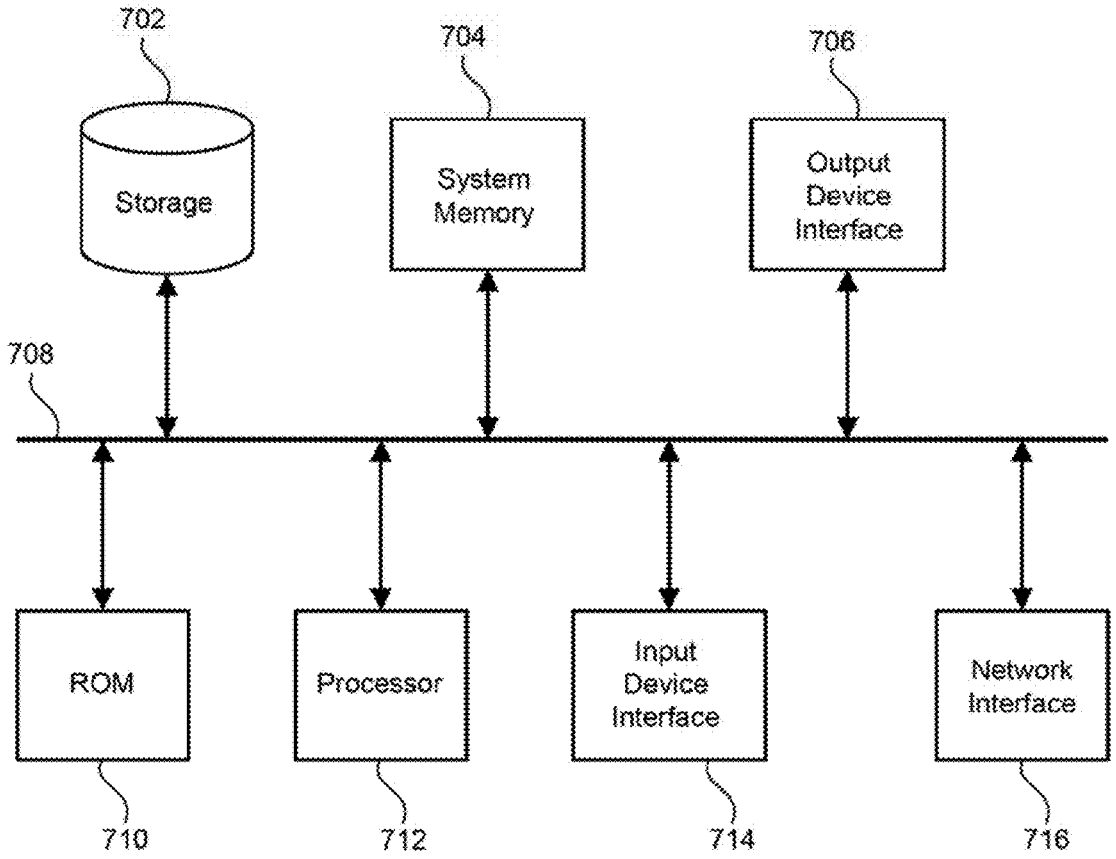
FIG. 7 is a diagram conceptually illustrating an example electronic system for use in connection with simulating a virtual card game, including a processor and other related components.

FIG. 7 is a diagram conceptually illustrating an example electronic system 700 for use in connection with simulating a virtual card game, including a processor and other related components, according to one or more implementations of the subject technology. Electronic system 700 can be a server, computer, phone, PDA, laptop, tablet computer, television with one or more processors embedded therein or coupled thereto, or any other sort of electronic device. Electronic system 700 may be representative of, for example, apparatus 100 or game circuitry 403. Such an electronic system includes various types of computer readable media and interfaces for various other types of computer readable media. Electronic system 700 includes a bus 708, processing unit(s) 712, a system memory 704, a read-only memory (ROM) 710, a permanent storage device 702, an input device interface 714, an output device interface 706, and a network interface 716.

Bus 708 collectively represents all system, peripheral, and chipset buses that communicatively connect the numerous internal devices of electronic system 700. For instance, bus 708 communicatively connects processing unit(s) 712 with ROM 710, system memory 704, and permanent storage device 702.

From these various memory units, processing unit(s) 712 retrieves instructions to execute and data to process in order to execute the processes of the subject disclosure. The processing unit(s) can be a single processor or a multi-core processor in different implementations.

ROM 710 stores static data and instructions that are needed by processing unit(s) 712 and other modules of the electronic system. Permanent storage device 702, on the other hand, is a read-and-write memory device. This device is a non-volatile memory unit that stores instructions and data even when electronic system 700 is off. Some implementations of the subject disclosure use a mass-storage device (such as a magnetic or optical disk and its corresponding disk drive) as permanent storage device 702.

Other implementations use a removable storage device (such as a floppy disk, flash drive, and its corresponding disk drive) as permanent storage device 702. Like permanent storage device 702, system memory 704 is a read-and-write memory device. However, unlike storage device 702, system memory 704 is a volatile read-and-write memory, such a random access memory. System memory 704 stores some of the instructions and data that the processor needs at runtime. In some implementations, the processes of the subject disclosure are stored in system memory 704, permanent storage device 702, and/or ROM 710. For example, the various memory units include instructions for facilitating remote betting in live games according to various implementations. From these various memory units, processing unit(s) 712 retrieves instructions to execute and data to process in order to execute the processes of some implementations.

Bus 708 also connects to input and output device interfaces 714 and 706. Input device interface 714 enables the user to communicate information and select commands to the electronic system. Input devices used with input device interface 714 include, for example, alphanumeric keyboards and pointing devices (also called "cursor control devices"). Output device interfaces 706 enables, for example, the display of images generated by the electronic system 700. Output devices used with output device interface 706 include, for example, printers and display devices, such as cathode ray tubes (CRT) or liquid crystal displays (LCD). Some implementations include devices such as a touch-screen that functions as both input and output devices.

Finally, as shown in FIG. 7, bus 708 also couples electronic system 700 to a network (not shown) through a network interface 716. In this manner, the computer can be a part of a network of computers (such as a local area network ("LAN"), a wide area network ("WAN"), or an Intranet, or a network of networks, such as the Internet. Any or all components of electronic system 700 can be used in conjunction with the subject disclosure.

These functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD-RW, etc.), flash memory (e.g., SD cards, mini-SD cards, micro-SD cards, etc.), magnetic and/or solid state hard drives, read-only and recordable Blu-Ray® discs, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "server", "processor", and "memory" all refer to electronic or other technological devices. These terms exclude people or groups of people. For the purposes of the specification, the terms display or displaying means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

To provide for interaction with a user, implementations of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

Implementations of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some implementations, a server transmits data (e.g., an HTML page) to a client device (e.g., for purposes of displaying data to and receiving user input from a user interacting with the client device). Data generated at the client device (e.g., a result of the user interaction) can be received from the client device at the server.

It is understood that any specific order or hierarchy of steps in the processes disclosed is an illustration of example approaches. Based upon design preferences, it is understood that the specific order or hierarchy of steps in the processes may be rearranged, or that some illustrated steps may not be performed. Some of the steps may be performed simultaneously. For example, in certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, where reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "exemplary" is used herein to mean "serving as an example or illustration." Any aspect or design described herein as "exemplary" is not necessarily to be construed as preferred or advantageous over other aspects or designs.

What is claimed is:

1. A method for facilitating play of a roulette-based card game, the method comprising:

providing at least two random number generator devices for a single card game;

providing a game apparatus comprising one or more processors and a non-transitory memory medium, the one or more processors configured to facilitate, by way of executing instructions stored on the memory medium, conducting the single card game and providing a plurality of game plays for selection in the single card game, each game play being for at least one game outcome of the single card game;

receiving, by the game apparatus, a selection of at least one of the plurality of game plays for the single card game, including a selection of a selected symbol of a first predetermined symbol and a second predetermined symbol;

activating, by the game apparatus, the at least two random number generator devices to produce at least two respective game values during the single card game based on a combined result of the two random number generator devices, a first activated device of the at least two random number generator devices being activated before a second activated device of the at least two random number generator devices;

upon the random number generators producing the at least two respective game values, assigning a first of the respective game values produced by the first activated device to the first predetermined symbol, and assigning a second of the respective game values produced by the second activated device to the second predetermined symbol;

identifying, by the game apparatus, whether one or more game outcomes exist for the single card game based on the produced at least two respective game values, the selected symbol, and the produced respective game value assigned to the selected symbol; and facilitate, based on the identifying, providing at a payout device a payout in a form of a physical item representing a monetary value.

2. The method of claim 1, wherein each random number generator device produces a game value from a respective predetermined set of game values, each game value being at least one of a numerical value, a card suit, and a non-number image.

3. The method of claim 2, wherein the plurality of game plays comprise:

one of the number generator devices producing a highest value of the number generator devices;

one or more of the number generator devices producing a game value below a first predetermined value;

one or more of the number generator devices producing a game value above a second predetermined value; and the at least two number generator devices producing equal values.

4. The method of claim 3, wherein the first predetermined value and the second predetermined value are equal.

5. The method of claim 4, wherein the first predetermined value and the second predetermined value is seven.

6. The method of claim 2, wherein at least one random number generator device is a game wheel configured to spin a ball around a circumference of the game wheel until it lands in one of a plurality of compartments positioned about an interior portion of the game wheel, each compartment associated with a respective one of the game values.

7. The method of claim 6, wherein each random number generator device is a game wheel.

8. The method of claim 2, wherein each game value in each respective predetermined set of game values is associated with one of three predetermined designations.

9. The method of claim 8, wherein each predetermined set of game values is representative of a set of thirty-nine playing cards, with each of the three predetermined designations being associated with thirteen of the set of thirty-nine playing cards.

10. The method of claim 2, wherein at least one random number generator device is a dealing shoe storing randomly shuffled cards, the shoe being activated by a dealing of a card representative of a respective one of the game values.

11. A system, the comprising:

at least two random number generating devices arranged for use in a single card game;

a game apparatus operatively connected to the at least two random number generating devices and comprising one or more processors and a non-transitory memory medium storing instructions, wherein the instructions when executed by the one or more processors cause the game apparatus to:

provide, for user selection, a plurality of game plays, each game play being for at least one game outcome of the single card game;

receive a selection of at least one of the plurality of game plays for the single card game, including a selection of a selected symbol of a first predetermined symbol and a second predetermined symbol;

activate the at least two random number generating devices to produce at least two respective game values during the single card game based on a combined result of the at least two random number generators, a first activated device of the at least two random number generating devices being activated before a second activated device of the at least two random number generator devices;

upon the random number generating devices producing the at least two respective game values, assigning a first of the respective game values produced by the first activated device to the first predetermined symbol, and assigning a second of the respective game values produced by the second activated device to the second predetermined symbol;

identify if one or more game outcomes exist for the single card game based on the produced at least two respective game values, the selected symbol, and the produced respective game value assigned to the selected symbol; and facilitate, based identifying the one or more game outcomes exist, providing at a payout device a payout in a form of a physical item representing a monetary value.

12. A system for simulating a single card game, the system comprising:

a display screen configured to display a user interface;

a payout device; and game circuitry comprising one or more processors and a non-transitory memory medium storing instructions, wherein the instructions when executed by the one or more processors cause the game circuitry to:

provide for display, at the display screen, multiple simulated game wheels in the single card game, each game wheel, when activated, spinning a ball around a circumference of the wheel until it lands in one of a plurality of compartments representative of a plurality of respective playing cards;

provide for selection, during the single card game, a plurality of game outcomes comprising one of the game wheels producing a highest ranking card of the game wheels, the game wheels producing a pair of cards, one or more of the game wheels producing a card having a rank below a first predetermined value, and one or more of the game wheels producing a card having a rank above a second predetermined value;

receive one or more wagers in a form of a physical item representing a monetary value from one or more players, each wager being for a selected outcome of the plurality of game outcomes, the selected outcome including a selected symbol of a first predetermined symbol and a second predetermined symbol;

simulate a spin of the game wheels, during the single card game, to produce, at the display screen, two respective game values, a first wheel of the game wheels being spun before a second wheel of the game wheels;

assigning a first game value of the respective game values produced by the first wheel to the first predetermined symbol, and assigning a second game value of the respective game values produced by the second wheel to the second predetermined symbol; and settle the one or more wagers based on the produced two respective game values, the selected symbol, and the produced respective game value assigned to the selected symbol, including facilitating providing at the payout device a payout in a form of a physical item representing a monetary value.

13. The system of claim 12, wherein the plurality of respective playing cards are divided into multiple sections such that each card is associated with one of the multiple sections, the plurality of game outcomes further comprising one or more of the game wheels producing a card value associated with a preselected one of the sections, and each game wheel producing a card value associated with the same section.

14. The system of claim 13, wherein the plurality of respective playing cards are divided into three sections.

15. The system of claim 14, wherein each wheel has thirty-nine compartments representative of thirty-nine playing cards, with each section including thirteen of the thirty-nine playing cards.

16. The system of claim 12, wherein the first predetermined value and the second predetermined value are equal.

17. The system of claim 16, wherein the first predetermined value and the second predetermined value is seven.

18. The system of claim 12, wherein the game circuitry displays two game wheels.

19. A device for use in a single card game, the device comprising:

a display screen; and game circuitry comprising one or more processors and a non-transitory memory medium storing instructions, wherein the instructions when executed by the one or more processors cause the device to:

provide, on the display screen, a display of two random card generators in the single card game, each card generator, when activated, producing one of a predetermined number of cards;

provide, during the single card game, a group of selectable outcomes comprising one of the card generators producing a winning card, the card generators producing cards having equal ranks, one or more of the card generators producing a card having a rank below a first predetermined value, and one or more of the card generators producing a card having a rank above a second predetermined value;

receive, during the single card game, one or more wagers from one or more players, each wager being for one of the selectable outcomes, including a selected symbol of a first predetermined symbol and a second predetermined symbol, and being in a form of a physical item representing a monetary value;

after receiving the one or more wagers, activate, during the single card game, the card generators to produce two respective game values, a first card generator of the card generators being activated before a second card generator of the card generators; and settle, for the single card game, the one or more wagers based on the produced two respective game values, the selected symbol, and the produced respective game value assigned to the selected symbol, including facilitating a payout in a form of a physical item representing a monetary value from a physical dispenser or distributor.

* * * * *